US010512807B2

(12) United States Patent
Madding

(10) Patent No.: US 10,512,807 B2
(45) Date of Patent: Dec. 24, 2019

(54) PORTABLE FIRE HOSE DEWATERING DEVICE

(71) Applicant: James Madding, Muncie, IN (US)

(72) Inventor: James Madding, Muncie, IN (US)

( * ) Notice: Subject to any disclaimer, the term of this patent is extended or adjusted under 35 U.S.C. 154(b) by 95 days.

(21) Appl. No.: 15/814,219

(22) Filed: Nov. 15, 2017

(65) Prior Publication Data

US 2018/0133527 A1 May 17, 2018

Related U.S. Application Data

(60) Provisional application No. 62/422,304, filed on Nov. 15, 2016.

(51) Int. Cl.
*A62C 33/02* (2006.01)
*F26B 5/14* (2006.01)

(52) U.S. Cl.
CPC ..... *A62C 33/02* (2013.01); *F26B 5/14* (2013.01)

(58) Field of Classification Search
CPC ..... F26B 5/16; F26B 5/14; F26B 5/00; A62C 33/02
USPC ..... 34/108
See application file for complete search history.

(56) References Cited

U.S. PATENT DOCUMENTS 756,717 A * 4/1904 Schools ..... F26B 9/003 312/351
760,952 A 5/1904 Britton
1,327,690 A * 1/1920 Wood ..... D06F 45/00 68/263 R
2,606,436 A * 8/1952 Ferris ..... D06F 45/16 68/255
2,748,586 A * 6/1956 Cooper ..... D06F 45/18 68/207
3,209,466 A * 10/1965 Van Laar ..... A62C 33/02 34/104
3,531,059 A 9/1970 Walker
4,403,424 A * 9/1983 Wahlstrom ..... F26B 9/06 34/104
4,452,135 A * 6/1984 Hayes ..... A62C 33/02 100/100
4,502,175 A 3/1985 Hillis
5,027,531 A * 7/1991 Wiens ..... A62C 33/02 248/89
5,191,722 A * 3/1993 Nayyar ..... A62C 33/02 34/104
5,349,763 A * 9/1994 Hafenrichter ..... A62C 33/02 34/104
D356,406 S 3/1995 Emery
6,135,139 A 10/2000 Blake, Jr.
(Continued)

FOREIGN PATENT DOCUMENTS

JP 01269034 A * 10/1989 ..... B65B 19/28

*Primary Examiner* — Stephen M Gravini
(74) *Attorney, Agent, or Firm* — John D Ritchison; Ritchison Law Offices, PC

(57) ABSTRACT

A portable fire hose dewatering device made of durable materials and used by one or more persons. It is considered fire fighting equipment and more specifically for efficiently removing the water from fire hoses prior to the hoses being rolled and stored. The device includes a mounting base, a rotatable shaft, bearings at the shaft ends, a pair of side structures/flanges on the mounting base, a spacer bar, and a set of pull handles connected to the side flanges.

18 Claims, 5 Drawing Sheets

(56) References Cited

U.S. PATENT DOCUMENTS

Figures 1A, 1B, 1C:
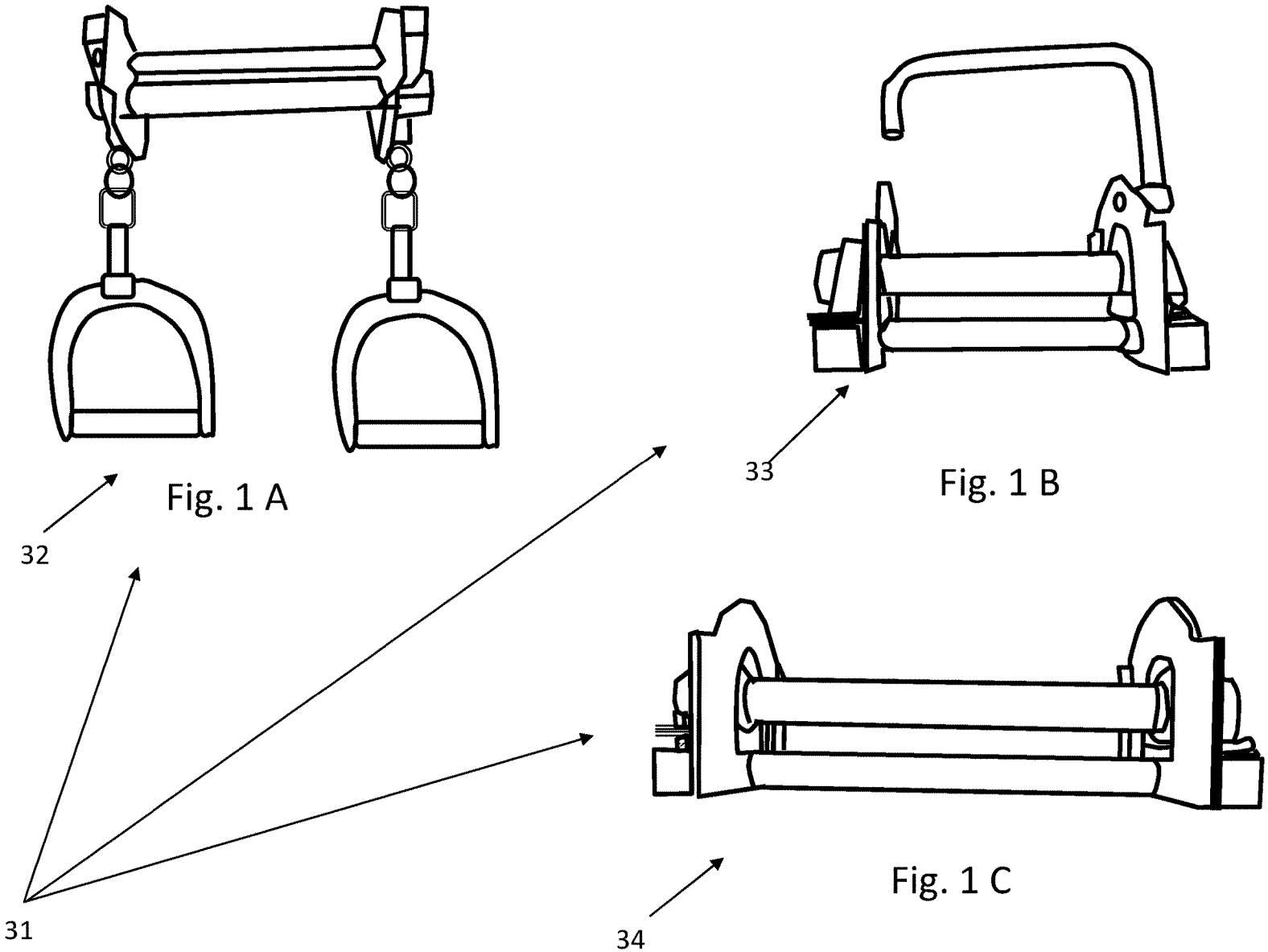
Figure 2A:
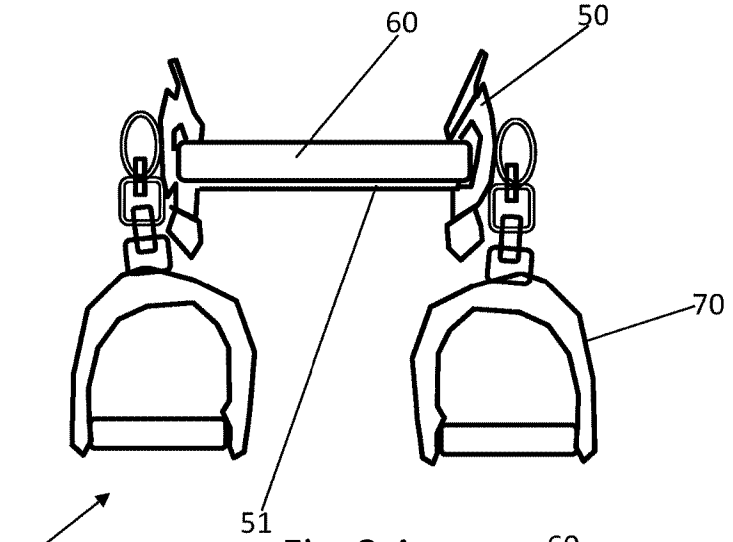
Figure 2B:
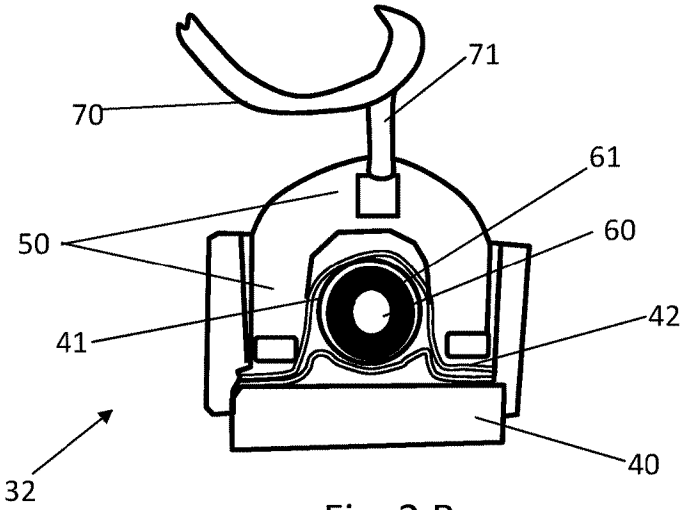
Figure 2C:
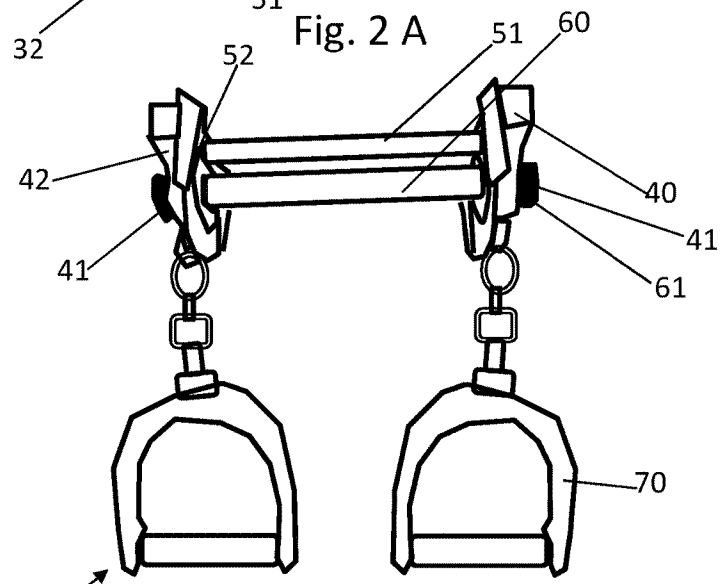
Figure 2D:
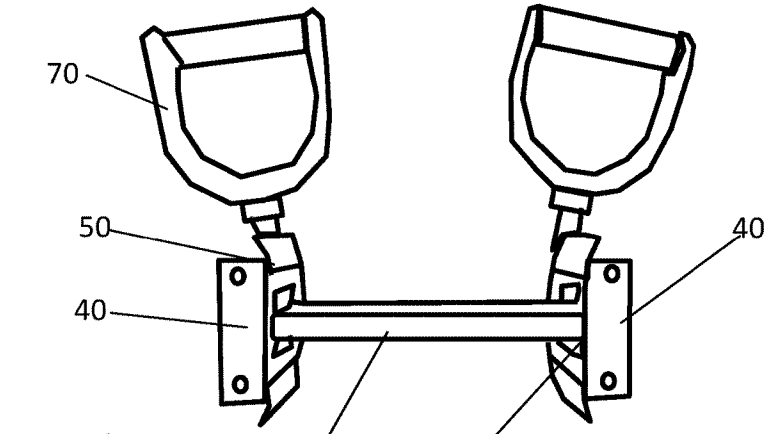
Figure 3B:
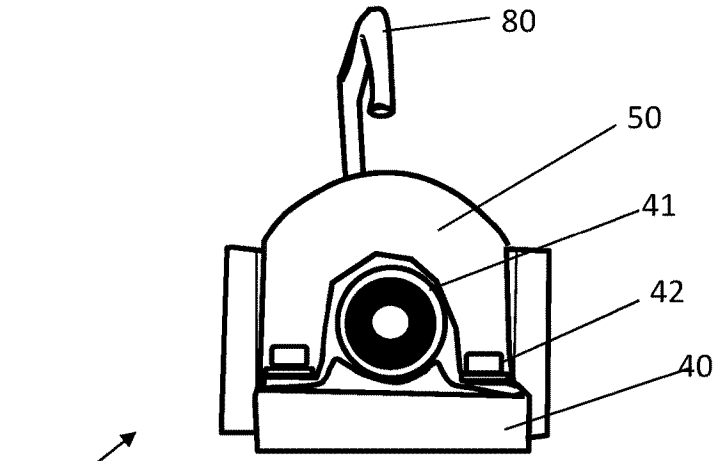
Figure 3D:
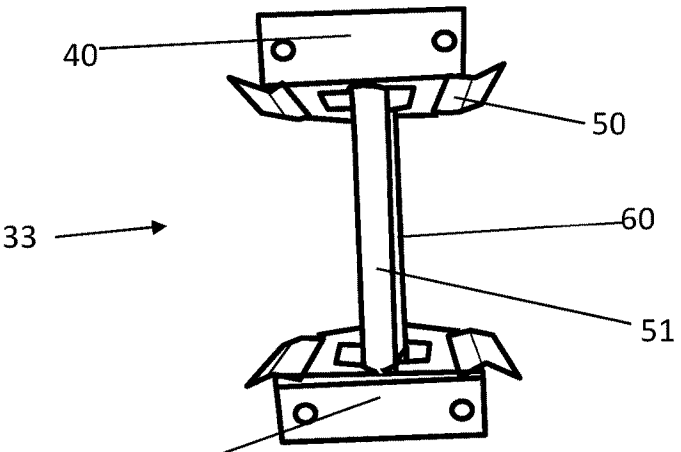
Figure 3A:
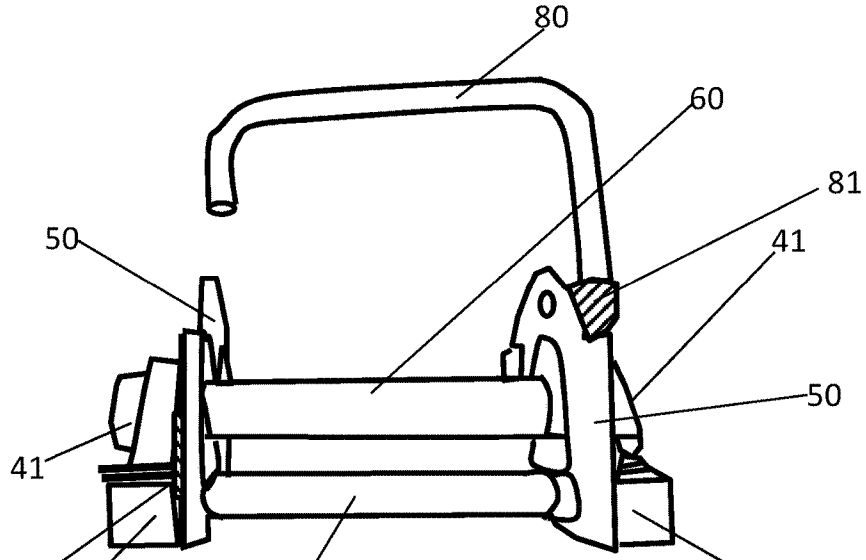
Figure 3C:
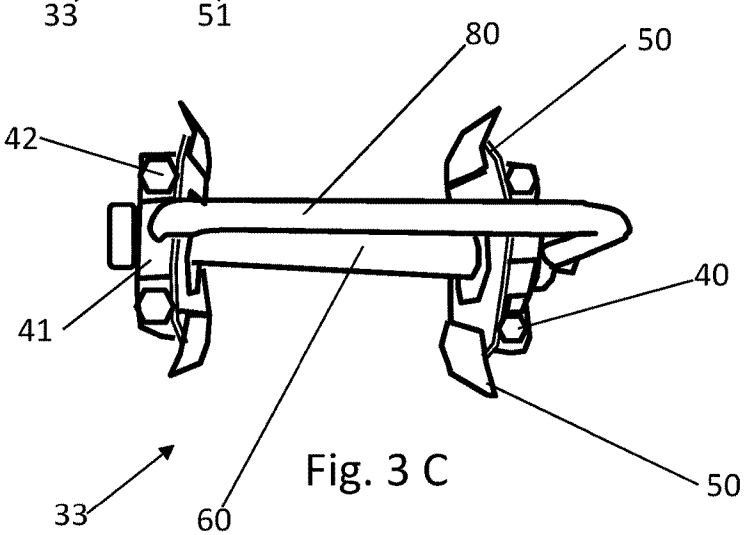
Figure 4C:
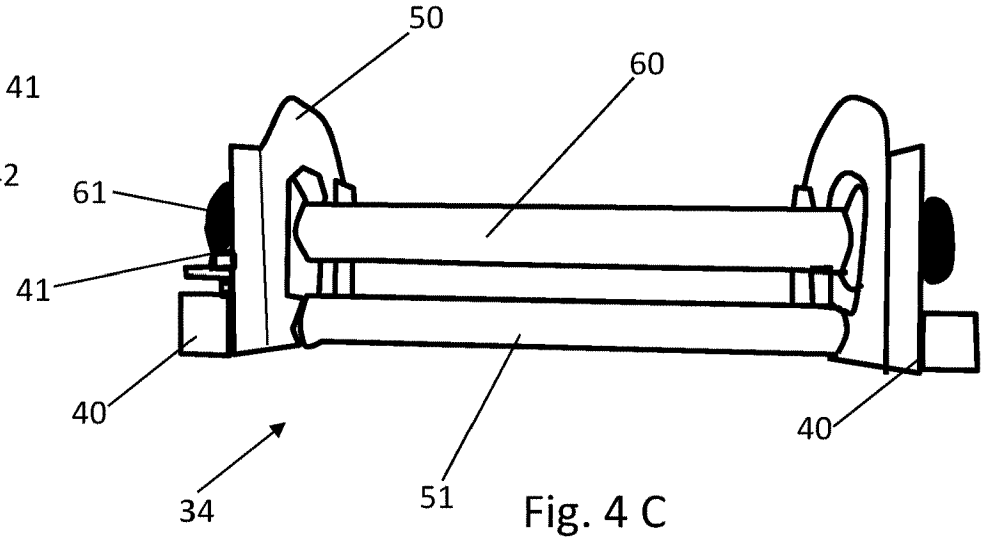
Figure 4D:
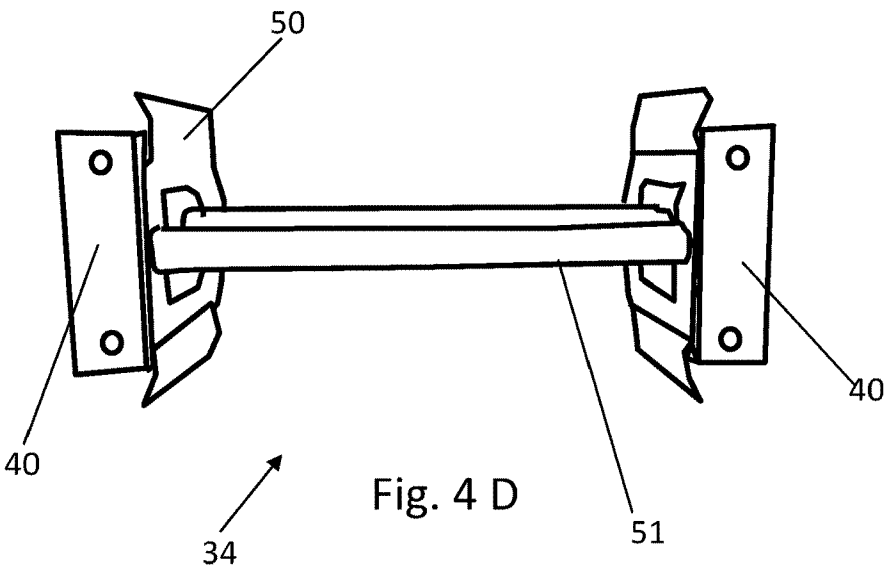
Figure 4B:
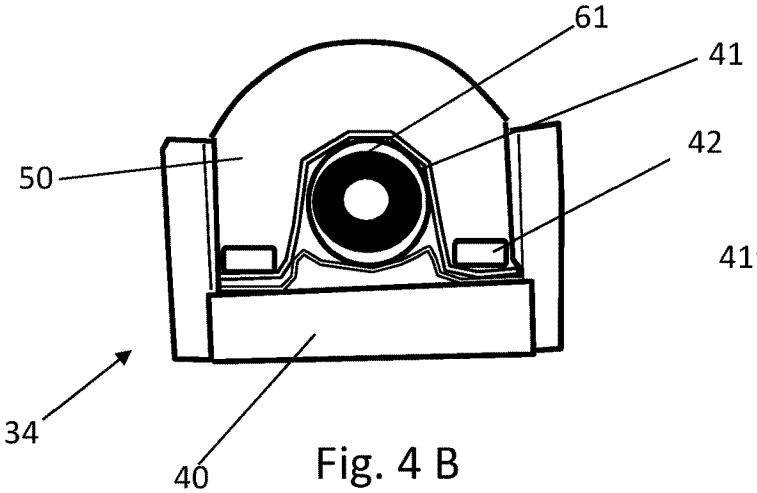
Figure 4A:
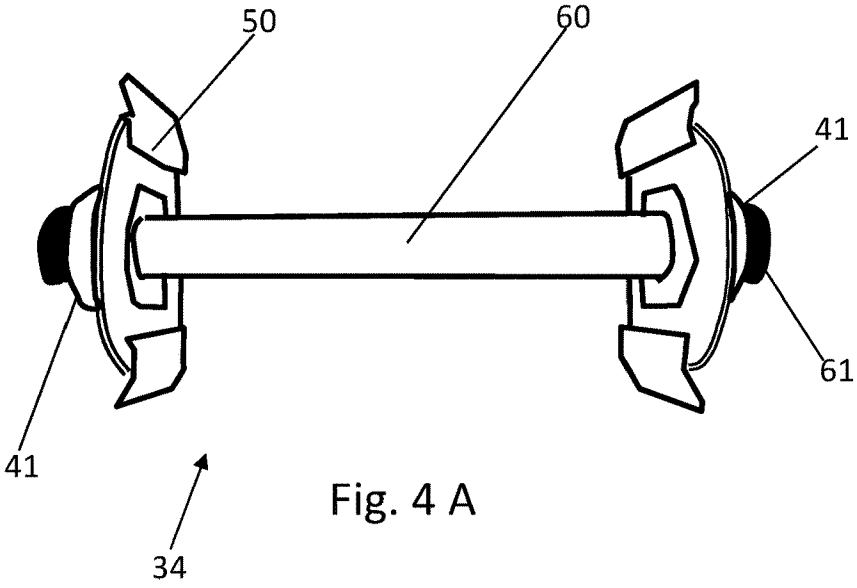

| | | | | |
|---|---|---|---|---|
| 7,024,797 | B2 * | 4/2006 | Bessa | A62C 33/02 34/103 |
| 7,793,881 | B1 | 9/2010 | Torres | |
| 8,376,202 | B2 | 2/2013 | Baker | |
| 8,539,693 | B2 * | 9/2013 | Perry | A47J 43/24 188/72.9 |
| 8,955,786 | B2 * | 2/2015 | Motoji | A62C 33/04 137/355.26 |
| 9,884,214 | B1 * | 2/2018 | Al-Mutairi | B65H 54/585 |
| 2005/0011979 | A1 * | 1/2005 | Best | A62C 33/02 242/370 |
| 2006/0162782 | A1 | 7/2006 | McNeese | |
| 2010/0078184 | A1 * | 4/2010 | Pellittiere, II | A62C 31/12 169/51 |
| 2014/0197219 | A1 | 7/2014 | Baker | |
| 2018/0133527 | A1 * | 5/2018 | Madding | A62C 33/02 |

* cited by examiner

All Sketches Prior Art
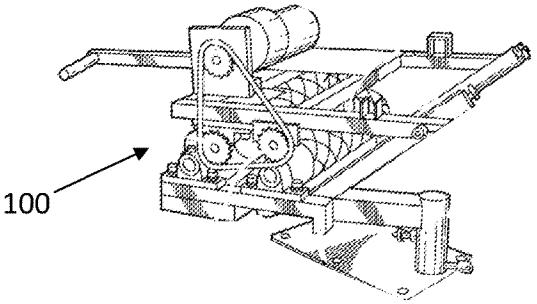
US Pub 2014/0197219
Prior Art
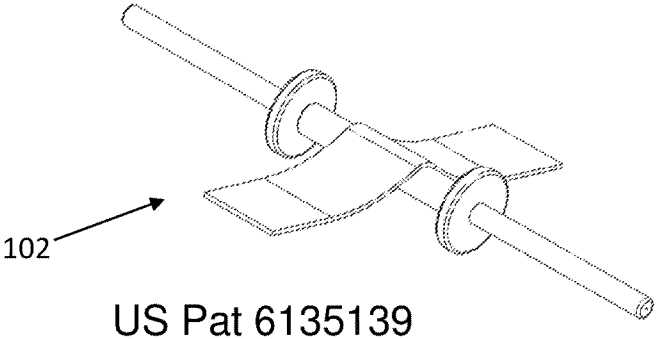
US Pat 6135139
Prior Art
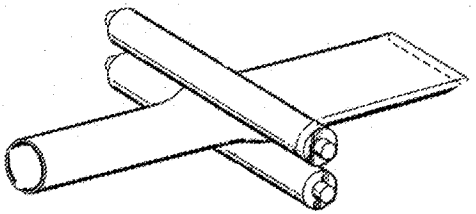
Fig. 5 A
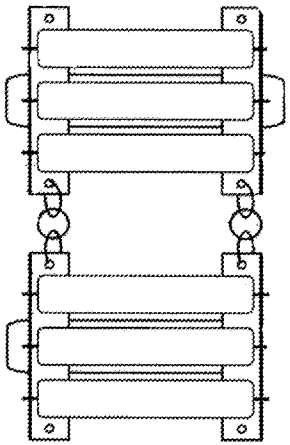
Fig. 5 B
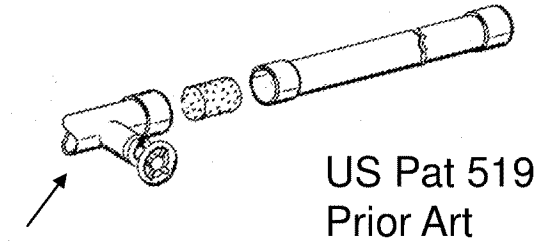
US Pat 5191722
Prior Art
Fig. 5 C
US Pub 2006/0162782
Prior Art
Fig. 5 D

PORTABLE FIRE HOSE DEWATERING DEVICE

CROSS-REFERENCE TO RELATED APPLICATIONS

This application claims the benefit of U.S. Provisional Patent Application with Ser. No. 62/422,304 filed Nov. 15, 2016, by James Madding and entitled "Special portable fire hose de-watering device".

FIELD OF INVENTION

The disclosures made herein relate generally to the fire-fighting industry. The invention discussed herein is in the general classification of a hose preparation apparatus and system that is designed to prepare and dewater flexible hoses used for conveying liquids such as fire hoses. This invention more particularly relates to a portable fire hose dewatering device.

The present invention relates generally to the field of firefighting equipment and more specifically to a device for efficiently removing the water from fire hoses prior to the hoses being rolled and stored. This invention relates further to an apparatus for draining elongated hoses prior to the hoses being hung for drying or rolled for storage. More particularly, this invention relates to an apparatus for draining hoses (e.g., fire hoses).

FEDERALLY SPONSORED RESEARCH

None.

SEQUENCE LISTING OR PROGRAM

None.

BACKGROUND

Field of Invention and Prior Art

As far as known, there are no portable fire hose dewatering device or the like. It is believed that this product is unique in its design and technologies.

PRIOR ART

A diligent novelty search was completed but the prior are revealed no applications or patents that anticipated or rendered obvious the James Madding device. Prior art includes: A Patent Application No. US2014/0197219 entitled Apparatus and System for Retrieving Hose was submitted by Baker in 2014. A U.S. Pat. No. 8,376,202 was issued to Baker in 2013 entitled Apparatus for Recovering Hose. Another U.S. Pat. No. 7,793,881 called a Portable Multiple Hose Roller was issued in 2010 to Torres. Then a US Patent Application No. US2006/0162782 was submitted by McNeese and known as a Fire Hose Roller. A U.S. Pat. No. 6,135,139 called an Apparatus for Draining Hose was issued to Blake Jr. in 2000. A design patent No. DES 356,406 named a Fire Hose Wringer was issued to Emery in 1995. Another U.S. Pat. No. 5,191,722 entitled Method and Arrangements for Drying of Fire Hoses was issued to Nayyer et al. in 1993. Next, a further U.S. Pat. No. 5,027,531 called an Apparatus for Drying Hoses in a Fire Wall issued to Wiens in 1995. In 1985, U.S. Pat. No. 4,502,175 Issued to Hillis called a Portable Fire Hose Cleaning Apparatus.

Before that, in 1968 a U.S. Pat. No. 3,531,059 named a Loader, Cleaner, and Drier for Fire Hose was issued to Walker. A U.S. Pat. No. 3,209,466 called and entitled a Hose Drying Apparatus was issued to Van Laar in 1963. An old U.S. Pat. No. 760,952 called a Hose Puller and Wringer was issued in 1904 to J. A. Britton. None are as simplistic and portable as the Madding device.

BACKGROUND

This section introduces aspects that may be helpful in facilitating a better understanding of the invention. Accordingly, the statements of this section are to be read in this light and are not to be understood as admissions about what is in the prior art or what is not in the prior art. Fire hoses are traditionally comprised of multiple sections having hose couplings at opposite ends. The hose couplings are made of metal and cannot be compressed in the same manner as the hose. It is well known in the firefighting field that long portions of flexible fire hose are difficult to recover after being utilized in a fire fighting situation. Long flexible fire hoses are notoriously difficult to retrieve and dewater after use due to the length, weight and large couplings used in connecting multiple sections of the hose. In typical day-to-day practice, several firefighters are necessary to recover and replace the fire hose, depending on the weight and length of the hose. A team of firefighters often must roll or fold up the flexible hose for storage on the fire engine. Such a burdensome practice may take many hours, and sometimes days, to complete.

A variety of automated or semi-automated hose retrieval and dewatering devices and systems have been employed, but all of these suffer from inherent disadvantages. Some of these disadvantages include the inability to recover larger quantities of hose without expending substantial manpower time and effort and the inability to compactly recover hoses fitted with hose couplings, especially large diameter hose couplings. Some of the prior art devices also require a user to disassemble the recovery apparatus to remove the wound hose after it is collected. Other devices collect the hose in a confined area within the recovery apparatus, making it difficult to access. Other prior art solutions utilize a complex and unreliable pulley and sensing system and/or a complex mechanical belting mechanism. Most of the prior art solutions also do not adequately address the dangers associated with couplings becoming stuck in the recovery apparatus and associated with operational belts being flung off the apparatus and/or debris being thrown off the hose by the apparatus. The prior art solutions also lack adjustability and the ability to customize to a given project and are frequently expensive to purchase and maintain.

Fire hoses are large, reinforced hoses that are capable of carrying and dispensing large amounts of water. Traditional fire hoses have a 3 IN (inch) diameter and are made of several layers of material, which make the hoses very durable. Unfortunately the layers of material also make fire hoses quite heavy. A new generation of fire hoses, called Large Diameter Hoses (LDH), are currently being deployed in firehouses throughout the United States. LDH hoses have a 5 IN (inch) diameter, which allows more water to be delivered to a fire. The new hoses are good for dispensing greater quantities of water however, they are also proportionately heavier than the traditional 3 IN (inch) diameter hoses.

When a fire has been put out and the firemen are ready to clean up and go back to the station, some of the tasks required of the firemen include rolling up the fire hoses and storing them back on the fire engine. However, before the hoses can be rolled up, the water that is left inside of the hoses must be removed. The traditional method of removing the water is for one or more firemen to lift one end of the hose, at least shoulder height, and then walk, while moving their hands hand over hand, down the length of the hose. This forces the water out of the opposite end of the hose. It also however, requires the firemen to lift the weight of the fire hose and the weight of the water remaining in the hose. While this traditional water removal method works, it is an awful lot to require of tired firemen that just got done fighting a fire.

Rollers are well-known in the field of roller paths systems and conveyer belts. A traditional roller includes an axle and an outer cylinder with multiple ball bearings held in place between the axle and the outer cylinder that allow the cylinder to rotate around the axle. In a typically roller path system, tens or even hundreds of rollers are placed parallel to each other with each roller being held by a long two-sided frame that extends from point A to point B. Boxes and cartons are efficiently moved, from point A to point B, by placing them on the roller path and pushing them along the rows of rollers. Non-motorized roller path systems usually have the destination end at a lower height than the loading end so movement of the boxes is assisted by gravity.

There is a need in the art for an easy to use, safe, adjustable, aesthetically pleasing, durable and relatively inexpensive hose dewatering device and system that allows fire hoses, including larger diameter hoses having larger couplings, to be recovered with minimal human intervention.

Problem Solved

The improvement and problem solved is providing a simple and portable hose dewatering device for use by professional and volunteer firefighters to enable them to easily and simply manipulate the hoses and remove water from the hoses prior to additional drying or placement back onto the trucks for operational use.

SUMMARY OF THE INVENTION

This invention is a portable fire hose dewatering device made of durable materials and used by one or more persons which is comprised of: (a) a mounting base or a pair of blocks; (b) a rotatable shaft; (c) a rotating component interplaced between each end of the mounting base/or a pair of blocks and the rotatable shaft; (d) a means for removably fastening bearing to a mounting base/or a pair of blocks such as but not limited to aperture and threads in the block and threaded bolt and washer or the like; (e) a pair of side structures/flanges on mounting base/pair of blocks; (f) a spacer bar interposed between side structures; (g) a means for fixedly securing spacer bar to side structure such as welding, brazing, molding or threadably fastening the rotatable shaft between bearing/bushings; (h) a means for removably securing the rotatable shaft to bearing bushing such as a collar and set screw or the like; (i) a pair of pull handles; and (j) a means for connecting the pull handles to the side structure/flange such as a quick connect, a carabiner, a hook and spring clip with a loop receiver, and a push lock connector fastened to the pull handles.

The newly invented portable fire hose dewatering device for various applications may be manufactured at low volumes by very simple means and in high volume production by more complex and controlled systems.

Objects and Advantages

There are several objects and advantages of the portable fire hose dewatering device. There are currently no known portable fire hose dewatering devices that are effective at providing the objects of this invention.

The portable fire hose dewatering device has various advantages and benefits:

| Item | Advantages |
|---|---|
| 1 | Is fast to use/dewater hoses |
| 2 | Has most component parts already produced |
| 3 | Is a universal designs for attachments to fit different tables, tool benches, truck platforms and the like |
| 4 | Can be used by professional and volunteer fire personnel |
| 5 | Is a single and a multi-fireman options |
| 6 | Is ergonomically helpful for user |

Finally, other advantages and additional features of the present portable fire hose dewatering device will be more apparent from the accompanying drawings and from the full description of the device. For one skilled in the art of firefighting equipment, especially hose preparation and maintenance, it is readily understood that the features shown in the examples with this product are readily adapted to other types of fire hose dewatering systems and devices.

DESCRIPTION OF THE DRAWINGS—FIGURES

The accompanying drawings, which are incorporated in and constitute a part of this specification, illustrate an embodiment of the portable fire hose dewatering device for various applications that is preferred. The drawings together with the summary description given above and a detailed description given below serve to explain the principles of the portable fire hose dewatering device. It is understood, however, that the portable fire hose dewatering device is not limited to only the precise arrangements and instrumentalities shown.

FIGS. 1 A through 1 C are sketches of the portable fire hose dewatering devices for various applications.

FIGS. 2 A through 2 D are sketches of the portable fire hose dewatering device used by one or more persons with components and features noted.

FIGS. 3 A through 3 D are additional sketches of the portable fire hose dewatering device used by a single person with the components and features shown from several views.

FIGS. 4 A through 4 D are sketches of the portable fire hose dewatering device used by mounting on a table, platform, vehicle or other available planar surface for use with hose dewatering.

FIG. 5 A through 5 D are sketches of prior art in the field of dewatering devices for use with fire hoses.

DESCRIPTION OF THE DRAWINGS—REFERENCE NUMERALS

The following list refers to the drawings:

TABLE B

| Reference numbers - | |
|---|---|
| Ref # | Description |
| 31 | portable fire hose dewatering device 31 |
| 32 | the portable fire hose dewatering device used by one or more persons 32 |
| 33 | the portable fire hose dewatering device 33 used by a single person |
| 34 | the portable fire hose dewatering device 34 used by mounting on a table, platform, vehicle or other available planar surface for use with hose dewatering |
| 40 | mounting base/or a pair of blocks 40 |
| 41 | bearing, bushing or the like 41 |
| 42 | means 42 for removably fastening bearing 41 to a pair of blocks 40 |
| 43 | aperture and threads 43 in the block 40 |
| 44 | threaded bolt and washer or the like 44 |
| 50 | side structure or flanged 50 on mounting block/base 40 |
| 51 | spacer bar 51 interposed between side structures 50 |
| 52 | means for securing 52 spacer bar 51 to side structure 50 such as welding, brazing, molding or thread ably fastening |
| 60 | rotatable shaft 60 between bearing/bushings 41 with a rough finish such as a rubberized coating, a urethane coating, a knurled surface, a powder coated with embedded sand, and an epoxy paint with embedded sand. |
| 61 | means 61 for removably securing rotating shaft 60 to bearing bushing 41 such as a collar and set screw 62 or the like |
| 62 | collar and set screw 62 |
| 70 | pull handles 70 |
| 71 | means 71 for connecting pull handles 70 to the side structure/flange 50 such as a quick connect 72 fastened to the handle 70, a carabiner, a hook and spring clip with a loop receiver, and a push lock connector |
| 72 | quick connect 72 fastened to the handle 70 |
| 73 | eyebolt or aperture 73 fastened to the side flange 50 to accept the quick connect 72 |
| 80 | simple one person handle 80 such as an angled rod or the like |
| 81 | means for fastening 81 one person handle 80 to one of the side flanges 50 such as welding, brazing or a threaded fastener |
| 90 | means for fastening 90 the mounting base/blocks 40 to a platform or planar surface such as threaded fasteners or the like |
| 100 | prior Art 100 US Pub 2014/0197219 |
| 101 | prior Art 101 U.S. Pat. No. 5,191,722 |
| 102 | prior Art 102 U.S. Pat. No. 6,135,139 |
| 103 | prior Art 103 US Pub 2006/0162782 |

Detailed Description of Preferred Embodiment

The disclosures made herein relate generally to the firefighting industry. The invention discussed herein is in the general classification of a hose preparation apparatus and system that is designed to prepare and dewater flexible hoses used for conveying liquids such as fire hoses. This invention more particularly relates to a portable fire hose dewatering device. The present invention relates generally to the field of firefighting equipment and more specifically to a device for efficiently removing the water from fire hoses prior to the hoses being rolled and stored. This invention relates further to an apparatus for draining elongated hoses prior to the hoses being hung for drying or rolled for storage. More particularly, this invention relates to an apparatus for draining hoses (e.g., fire hoses).

The advantages for the portable fire hose dewatering device 31 are listed above in the introduction. Succinctly the benefits are that the device:

A. Fast to use/dewater hoses
B. Most parts already produced
C. Universal designs for attachments to fit different tables, tool benches, truck platforms and the like
D. Use can be by professional and volunteer fire personnel
E. Single and multi-fireman options
F. Ergonomically helpful for user The preferred embodiment of a portable fire hose dewatering device made of durable materials and used by one or more persons which is comprised of: (a) a mounting base or a pair of blocks; (b) a rotatable shaft; (c) a rotating component interplaced between each end of the mounting base/or a pair of blocks and the rotatable shaft; (d) a means for removably fastening bearing to a mounting base/or a pair of blocks such as but not limited to aperture and threads in the block and threaded bolt and washer or the like; (e) a pair of side structures/flanges on mounting base/pair of blocks; (f) a spacer bar interposed between side structures; (g) a means for fixedly securing spacer bar to side structure such as welding, brazing, molding or threadably fastening the rotatable shaft between bearing/bushings; (h) a means for removably securing the rotatable shaft to bearing bushing such as a collar and set screw or the like; (i) a pair of pull handles; and (j) a means for connecting the pull handles to the side structure/flange such as a quick connect, a carabiner, a hook and spring clip with a loop receiver, and a push lock connector fastened to the pull handles.

There is shown in FIGS. 1-5 a complete description and operative embodiment of the portable fire hose dewatering device. In the drawings and illustrations, one notes well that the FIGS. 1-5 demonstrate the general configuration and use of this product. The various example uses are in the operation and use section, below.

The accompanying drawings, which are incorporated in and constitute a part of this specification, illustrate an embodiment of the portable fire hose dewatering device 31 that is preferred. The drawings together with the summary description given above and a detailed description given below serve to explain the principles of the portable fire hose dewatering device 31. It is understood, however, that the device 31 is not limited to only the precise arrangements and instrumentalities shown. Other examples of fire hose dewatering devices and uses are still understood by one skilled in the art of firehose dewatering devices and mechanisms to be within the scope and spirit shown here.

FIGS. 1 A through 1 C are sketches of the portable fire hose dewatering devices for various applications. Shown hewer are the various embodiments of the portable fire hose dewatering device 31. Included are the portable fire hose dewatering device used by one or more persons 32; the portable fire hose dewatering device 33 used by a single person; and the portable fire hose dewatering device 34 used by mounting on a table, platform, vehicle or other available planar surface for use with hose dewatering.

FIGS. 2 A through 2 D are sketches of the portable fire hose dewatering device 32 used by one or more persons with components and features noted. Demonstrated and shown here are: the portable fire hose dewatering device used by one or more persons 32; mounting base/or a pair of blocks 40; a bearing, bushing or the like 41; a means 42 for removably fastening bearing 41 to a pair of blocks 40 such as but not limited to aperture and threads 43 in the block 40 and threaded bolt and washer or the like 44; a side structure or flanged 50 on mounting block/base 40; a spacer bar 51 interposed between side structures 50; a means for securing 52 spacer bar 51 to side structure 50 such as welding, brazing, molding or thread ably fastening the rotatable shaft 60 between bearing/bushings 41; a means 61 for removably securing rotating shaft 60 to bearing bushing 41 such as a collar and set screw 62 or the like; a collar and set screw 62; a pair of pull handles 70; a means 71 for connecting pull handles 70 to the side structure/flange 50 such as a quick connect 72 fastened to the handle 70, quick connect, a carabiner, a hook and spring clip with a loop receiver, and a push lock connector; the quick connect 72 fastened to the handle 70; and an eyebolt or aperture 73 fastened to the side flange 50 to accept the quick connect 72. The rough finish on the shaft 60 anticipates, for example and not as a limitation, such as a rubberized coating, a urethane coating, a knurled surface, a powder coated with embedded sand, and an epoxy paint with embedded sand.

FIGS. 3 A through 3 D are additional sketches of the portable fire hose dewatering device 33 used by a single person with the components and features shown from several views. Demonstrated and shown here are: the portable fire hose dewatering device used by one person 33; mounting base/or a pair of blocks 40; a bearing, bushing or the like 41; a means 42 for removably fastening bearing 41 to a pair of blocks 40 such as but not limited to aperture and threads 43 in the block 40 and threaded bolt and washer or the like 44; a side structure or flanged 50 on mounting block/base 40; a spacer bar 51 interposed between side structures 50; a means for securing 52 spacer bar 51 to side structure 50 such as welding, brazing, molding or thread ably fastening the rotatable shaft 60 between bearing/bushings 41; a means 61 for removably securing rotating shaft 60 to bearing bushing 41 such as a collar and set screw 62 or the like; a collar and set screw 62; simple one person handle 80 such as an angled rod or the like; and a means for fastening 81 one person handle 80 to one of the side flanges 50 such as welding, brazing or a threaded fastener.

FIGS. 4 A through 4 D are sketches of the portable fire hose dewatering device 34 used by mounting on a table, platform, vehicle or other available planar surface for use with hose dewatering. Demonstrated and shown here are: the portable fire hose dewatering device used by one or more persons 32; mounting base/or a pair of blocks 40; a bearing, bushing or the like 41; a means 42 for removably fastening bearing 41 to a pair of blocks 40 such as but not limited to aperture and threads 43 in the block 40 and threaded bolt and washer or the like 44; a side structure or flanged 50 on mounting block/base 40; a spacer bar 51 interposed between side structures 50; a means for securing 52 spacer bar 51 to side structure 50 such as welding, brazing, molding or thread ably fastening the rotatable shaft 60 between bearing/bushings 41; a means 61 for removably securing rotating shaft 60 to bearing bushing 41 such as a collar and set screw 62 or the like; a collar and set screw 62; and a means for fastening 90 the mounting base/blocks 40 to a platform or planar surface such as threaded fasteners or the like.

As on skilled in the art of devices such as shown here, these may be made of durable materials such as but not limited to: Metals, steel and alloy steel, coated or plated metals, composite materials including plastics and reinforced plastics; etc.

FIG. 5 A through 5 D are sketches of prior art in the field of dewatering devices for use with fire hoses. Shown as prior art are: prior Art 100 US Pub 2014/0197219; prior Art 101 U.S. Pat. No. 5,191,722; prior Art 102 U.S. Pat. No. 6,135,139; and prior Art 103 US Pub 2006/0162782.

The details mentioned here are exemplary and not limiting. Other specific components and manners specific to describing a portable fire hose dewatering device 31 may be added as a person having ordinary skill in the field of the art of firehose dewatering and preparation devices and their uses well appreciates.

Operation of the Preferred Embodiment

The portable fire hose dewatering device 31 has been described in the above embodiment. The manner of how the device operates is described below. One notes well that the description above and the operation described here must be taken together to fully illustrate the concept of the portable fire hose dewatering device 31. The preferred embodiment of a portable fire hose dewatering device made of durable materials and used by one or more persons comprised of: (a) a mounting base or a pair of blocks 40; (b) a rotatable shaft 60; (c) a rotating component 41 interplaced between each end of the mounting base/or a pair of blocks 40 and the rotatable shaft 60; (d) a means 42 for removably fastening bearing 41 to a mounting base/or a pair of blocks 40 such as but not limited to aperture and threads 43 in the block 40 and threaded bolt and washer or the like 44; (e) a pair of side structures/flanges 50 on mounting base/pair of blocks 40; (f) a spacer bar 51 interposed between side structures 50; (g) a means for fixedly securing 52 spacer bar 51 to side structure 50 such as welding, brazing, molding or threadably fastening the rotatable shaft 60 between bearing/bushings 41; (h) a means 61 for removably securing the rotatable shaft 60 to bearing bushing 41 such as a collar and set screw 62 or the like; (i) a pair of pull handles 70; and (j) a means 71 for connecting the pull handles 70 to the side structure/flange 50 such as a quick connect, a carabiner, a hook and spring clip with a loop receiver, and a push lock connector fastened to the pull handles 70.

The portable fire hose dewatering device 31 operates as follows: a fireman or pair of firemen take the device to the recently used/filled fire hoses. The lay the hoses out and place the device 31 under a partially filled hose. Next they pull the device (32 or 33) along the longitudinal portion of the hose and force the water out of the hose. This simple pull method under the hose is ergonomically helpful for user by eliminating the full weight of the hose while bending and twisting. This relieves stress to the back, shoulders and abdomen. For the mounted device 33, they pull the hose across the device 33 and again force the water from the hose.

Several uses are anticipated for the portable fire hose dewatering device 31. Some examples, and not limitations, are shown in the following Table.

| ITEM | DESCRIPTION |
|---|---|
| 1 | Fire site location dewatering |
| 2 | Training site location dewatering |

-continued

| ITEM | DESCRIPTION |
|---|---|
| 3 | Dewatering after Maintenance and pressure certification at the station |
| 4 | Dewatering at "fast-fill" sites such as home swimming pool fill-ups or business pond fillings |

With this description it is to be understood that the portable fire hose dewatering device 31 is not to be limited to only the disclosed embodiment of product. The features of the portable fire hose dewatering device 31 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed as new and desired to be protected by Letters Patent is:

1. A portable fire hose dewatering device made of a specific material and used by one person comprised of:

(a) a mounting base (40);

(b) a rotatable shaft (60);

(c) a rotating component (41) interplaced between each end of the mounting base (40) and the rotatable shaft (60);

(d) a means (42) for removably fastening the rotating component (41) to the mounting base (40);

(e) a pair of side structures each side having a pair of lead flanges 50 secured to the mounting base (40);

(f) a spacer bar (51) interposed between the pair of side structures (50);

(g) a means for fixedly securing (52) spacer bar (51) to the pair of side structures (50);

(h) a means (61) for removably securing the rotatable shaft (60) to the rotating component (41);

(i) a pair of pull handles (70); and (j) a means (71) for connecting each of the pair pull handles (70) to each of the pair of the side structures (50) wherein an end of a fire hose after use and the fire hose being partially full of an amount of water can be placed at the end of the fire hose and over the rotatable shaft whereby the device can be pulled along the fire hose to an opposite end of the fire hose by the person thereby forcing the amount of water out the beginning end of the fire hose thereby providing an emptied fire hose which is lighter and is ready for storage on a truck or at a fire house.

2. The portable fire hose dewatering device according to claim 1 further wherein the rotatable shaft is further comprised of a rough finish.

3. The portable fire hose dewatering device with the shaft having the rough finish according to claim 2 wherein the rough finish is selected from a group consisting of a rubberized coating, a urethane coating, a knurled surface, a powder coating with embedded sand, and an epoxy paint with embedded sand.

4. The portable fire hose dewatering device according to claim 1 wherein the means for removably fastening the rotating component to the mounting base is an aperture and threads in a block and a threaded bolt and a washer interplaced in an aperture in each end of the mounting base.

5. The portable fire hose dewatering device according to claim 1 wherein the rotating component is selected from a group consisting of a bearing and a bushing.

6. The portable fire hose dewatering device according to claim 1 wherein the means for fixedly securing the spacer bar to the side structure rotating component is selected from a group consisting of welding, brazing, molding and threadably fastening.

7. The portable fire hose dewatering device according to claim 1 wherein the means for removably securing the rotatable shaft to the rotating component is a collar and a set screw.

8. The portable fire hose dewatering device according to claim 1 wherein the means for connecting the pull handles to the side structures is selected from a group consisting of a quick connect, a carabiner, a hook and spring clip with a loop receiver, and a push lock connector.

9. The portable fire hose dewatering device according to claim 1 wherein the specific material is selected from a group consisting of metals, steel, alloy steel, coated and/or plated metals, composite material, plastic and reinforced plastic.

10. A portable fire hose dewatering device made of a specific material and used by one person comprised of:

(a) a pair of blocks;
(b) a rotatable shaft;
(c) a rotating component interplaced between each end of the pair of blocks and the rotatable shaft;
(d) a means for removably fastening the rotating component to the pair of blocks;
(e) a pair of side structures each side having a pair of lead flanges 50 secured to the pair of blocks;
(f) a spacer bar interposed between the pair of side structures;
(g) a means for fixedly securing the spacer bar to the side structure;
(h) a means for removably securing the rotatable shaft to rotating component;
(i) a pair of pull handles; and
(j) a means for connecting the pull handles to each of the pair of the side structures wherein an end of a fire hose after use and the fire hose being partially full of an amount of water can be placed at the end of the fire hose and over the rotatable shaft whereby the device can be pulled along the fire hose to an opposite end of the fire hose by the person thereby forcing the amount of water out the beginning end of the fire hose thereby providing an emptied fire hose which is lighter and is ready for storage on a truck or at a fire house.

11. The portable fire hose dewatering device according to claim 10 further wherein the rotatable shaft is further comprised of a rough finish.

12. The portable fire hose dewatering device with the shaft having the rough finish according to claim 11 wherein the rough finish is selected from a group consisting of a rubberized coating, a urethane coating, a knurled surface, a powder coated surface with embedded sand, and an epoxy paint with embedded sand.

13. The portable fire hose dewatering device according to claim 10 wherein the means for removably fastening the rotating component to the pair of blocks is an aperture and threads in the block, a threaded bolt, and a washer interplaced in the aperture at each end of the pair of blocks.

14. The portable fire hose dewatering device according to claim 10 wherein the rotating component is selected from a group consisting of a bearing and a bushing.

15. The portable fire hose dewatering device according to claim 10 wherein the means for fixedly securing spacer bar to the rotating component is selected from a group consisting of welding, brazing, molding, and threadably fastening.

16. The portable fire hose dewatering device according to claim 10 wherein the means for removably securing the rotatable shaft to rotating component is a collar and a set screw.

17. The portable fire hose dewatering device according to claim 10 wherein the means for connecting the pull handles to each of the side structures is selected from a group consisting of a quick connect, a carabiner, a hook and spring clip with a loop receiver, and a push lock connector.

18. The portable fire hose dewatering device according to claim 10 wherein the specific material is selected from a group consisting metals, steel, alloy steel, coated and/or plated metals, composite material, plastic and reinforced plastic.

* * * * *